US008585491B2

(12) United States Patent
Chim et al.

(10) Patent No.: US 8,585,491 B2
(45) Date of Patent: Nov. 19, 2013

(54) GAMING MACHINE

(75) Inventors: Chi We Chim, New South Wales (AU); William George Cormack, New South Wales (AU)

(73) Assignee: Aristocrat Technologies Australia Pty. Ltd. (AU)

( * ) Notice: Subject to any disclaimer, the term of this patent is extended or adjusted under 35 U.S.C. 154(b) by 131 days.

(21) Appl. No.: 12/690,668

(22) Filed: Jan. 20, 2010

(65) Prior Publication Data

US 2010/0120523 A1 May 13, 2010

Related U.S. Application Data

(62) Division of application No. 10/589,309, filed as application No. PCT/AU2005/000164 on Feb. 9, 2005, now abandoned.

(30) Foreign Application Priority Data

Feb. 9, 2004 (AU) ..... 2004900644

(51) Int. Cl.
*A63F 3/06* (2006.01)

(52) U.S. Cl.
USPC ..... 463/26; 463/27; 463/29

(58) Field of Classification Search
USPC ..... 463/37, 38, 26–28, 29
See application file for complete search history.

(56) References Cited

U.S. PATENT DOCUMENTS

| | | | | |
|---|---|---|---|---|
| 5,885,158 | A | 3/1999 | Torango et al. | |
| 6,003,307 | A | 12/1999 | Naber et al. | |
| 6,017,032 | A * | 1/2000 | Grippo et al. | 273/138.1 |
| 6,241,608 | B1 | 6/2001 | Torango | |
| 6,319,127 | B1 * | 11/2001 | Walker et al. | 463/26 |
| 6,340,158 | B2 | 1/2002 | Pierce et al. | |
| 6,398,644 | B1 | 6/2002 | Perrie et al. | |
| 6,435,968 | B1 | 8/2002 | Torango | |
| 6,514,141 | B1 | 2/2003 | Kaminkow et al. | |
| 6,592,460 | B2 | 7/2003 | Torango | |
| 2003/0211884 | A1 * | 11/2003 | Gauselmann | 463/26 |
| 2004/0009808 | A1 | 1/2004 | Gauselmann | |
| 2004/0023716 | A1 | 2/2004 | Gauselmann | |

FOREIGN PATENT DOCUMENTS

| | | | |
|---|---|---|---|
| AU | 199943453 | B1 | 8/1999 |
| AU | 200118314 | A1 | 2/2001 |
| AU | 2003203970 | A1 | 5/2003 |
| CA | 2334546 | A1 | 8/2001 |
| EP | 1341135 | A2 | 9/2003 |
| EP | 1376493 | A2 | 1/2004 |
| EP | 1380998 | A2 | 1/2004 |

OTHER PUBLICATIONS

International Search Report on PCT/AU2005/000164.

* cited by examiner

*Primary Examiner* — Damon Pierce
(74) *Attorney, Agent, or Firm* — McAndrews, Held & Malloy, Ltd.

(57) ABSTRACT

There is disclosed a gaming machine having a plurality of jackpot prizes associated with it, a player's eligibility to win one of the plurality of jackpot prizes being dependent upon an amount wagered. In a one aspect there is provided a gaming machine having a game control means arranged to play a game, a bet selecting arrangement for selecting one of a number of predetermined amounts to wager on the outcome of the game, each of said predetermined amounts to wager having at least one dedicated jackpot prize associated with it, a first display means configured to display the outcome of said game, wherein in the event that a predetermined winning event occurs said game includes the award of at least one dedicated jackpot prize associated with a respective selected predetermined amount wagered on the game.

11 Claims, 5 Drawing Sheets

GAMING MACHINE

CROSS-REFERENCE TO RELATED APPLICATIONS/INCORPORATION BY REFERENCE

The present application is a DIVISIONAL of U.S. application Ser. No. 10/589,309, filed Jun. 22, 2007 now abandoned, which is a National Phase filing of International Application No. PCT/AU2005/000164, filed Feb. 9, 2005, which claims priority to Australian Patent Application No. 2004900644, filed Feb. 9, 2004. The Applicant expressly hereby incorporates by reference each of the above identified applications herein in their entirety.

FIELD OF THE INVENTION

This invention relates to a gaming machine. More particularly, the invention relates to a gaming machine and to an improvement to a game played on such a gaming machine.

BACKGROUND TO THE INVENTION

Players who regularly play gaming machines quickly tire of particular games and therefore it is necessary for manufacturers of these machines to develop innovative game features which add interest to the games. In so doing, it is hoped to keep players amused and therefore willing to continue playing the game as well as to attract new players.

Also, with the growth that has occurred in the gaming machine market, there is intense competition between manufacturers to supply various existing and new venues.

When selecting a supplier of gaming machines, the operation of a venue will often pay close attention to the popularity of various games with their patrons. Therefore, gaming machine manufacturers are keen to devise games and/or game features which are popular with the players as a mechanism for improving sales, retaining customers and attracting new customers.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY OF THE INVENTION

Broadly, according to the invention, there is provided a gaming machine having a plurality of jackpot prizes associated with it, a player's eligibility to win one of the plurality of jackpot prizes being dependent upon an amount wagered.

In a first aspect there is provided a gaming machine having a game control means arranged to play a game, a bet selecting arrangement for selecting one of a number of predetermined amounts to wager on the outcome of the game, each of said predetermined amounts to wager having at least one dedicated jackpot prize associated with it, a first display means configured to display the outcome of said game, wherein in the event that a predetermined winning event occurs said game includes the award of at least one dedicated jackpot prize associated with a respective selected predetermined amount wagered on the game.

According to a second aspect of the invention, there is provided a gaming machine having a first display means and a game control means arranged to control images of symbols displayed on the first display means, the game control means being arranged to play a game wherein at least one random event is caused to be displayed on the first display means and, if a predefined winning event occurs, the machine awards a prize, the gaming machine further comprising a bet selecting arrangement for selecting one of a number of predetermined amounts to wager, and a plurality of jackpot prizes, each predetermined amount to wager having at least one jackpot prize associated with it.

The gaming machine can include a second display means configured to display a current value of the jackpot prizes. In one embodiment the second display means is mounted in a top box of the gaming machine.

The bet selecting arrangement can include, a keypad, a touch screen, an array of buttons, or the like.

The bet selection means is preferably configured to enable a selection of one of the predetermined amounts to wager prior to initiating game play.

The bet selection means can be further configured to enable a wager that is a multiple of a predetermined amount to wager. In the event that a player wagers a value that is a multiple of a predetermined amount to wager it is preferable that the player is eligible to win a jackpot prize associated with the predetermined amount to wager.

In certain embodiments of the gaming machine a plurality of jackpot prizes can be associated with at least one of the predetermined amounts to wager.

The jackpot prizes can be configured to accumulate from a predetermined minimum value and are incremented towards a predetermined maximum value. A jackpot prize associated with a particular predetermined amount to wager can be incremented by a portion of the amount wagered.

BRIEF DESCRIPTION OF THE DRAWINGS

Embodiments of the present invention will be described by way of example with reference to the accompanying diagrammatic drawings in which.

DETAILED DESCRIPTION OF THE DRAWINGS

Figure 1:
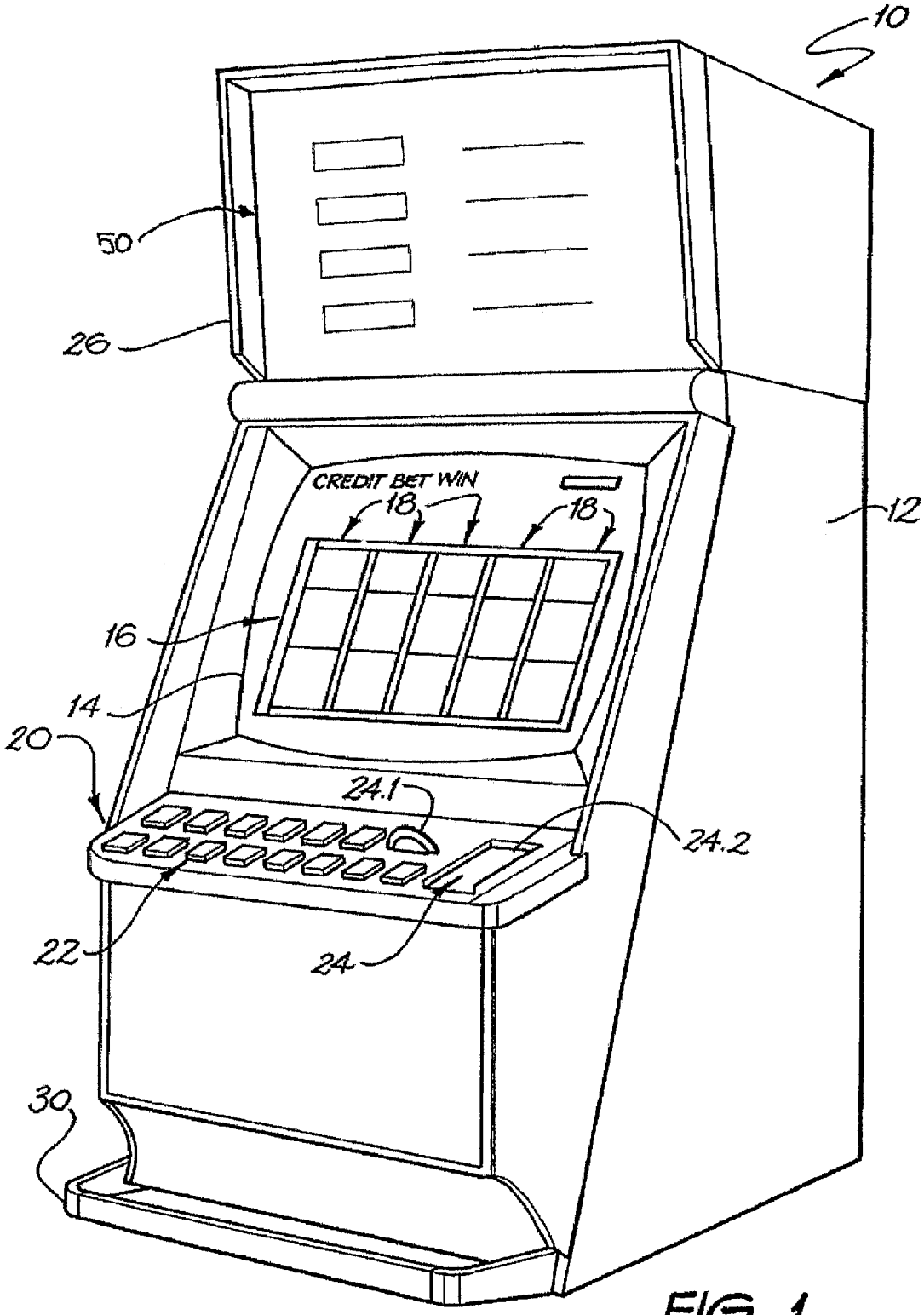
FIG. 1 shows a perspective view of a gaming machine, in accordance with an embodiment of the invention.

In FIG. 1, reference numeral 10 generally designates a gaming machine, in accordance with an embodiment of the invention. The machine 10 includes a console 12 having a display means in the form of a video display unit 14 on which a game 16 is displayed, in use. The video display unit 14 may be implemented as a cathode ray screen device, a liquid crystal display, a plasma screen, or the like. The game 16 is a spinning reel game which simulates the rotation of a number of spinning reels 18. A midtrim 20 of the machine 10 houses a bank 22 of buttons for enabling a player to play the game 16. The midtrim 20 also houses a credit input mechanism 24 including a coin input chute 24.1 and a bill collector 24.2.

The machine 10 includes a top box 26 carrying a second display 50 as will be described in greater detail below. A coin tray 30 is mounted beneath the console 12 for cash payouts from the machine 10.

Figure 2:
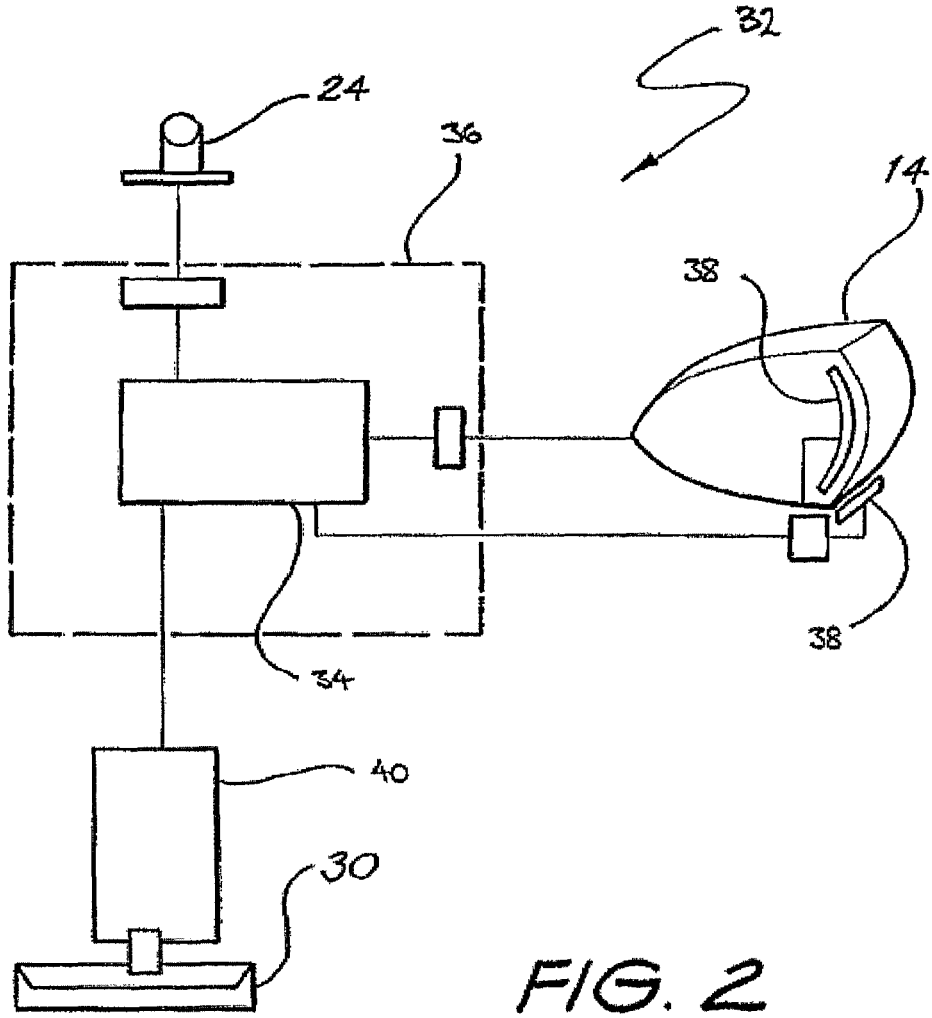
FIG. 2 shows a block diagram of a control circuit of the gaming machine of FIG. 1.

Referring to FIG. 2 of the drawings, a control means or control circuit 32 is illustrated. A program which implements the game and user interface is run on a processor 34 of the control circuit 32. The processor 34 forms part of a controller 36 that drives the screen of the video display unit 14 and that receives input signals from 15 sensors 38. The sensors 38 include sensors associated with the bank 22 of buttons and touch sensors mounted in the screen of the video display unit 14. The controller 36 also receives input pulses from the mechanism 24 to determine whether or not a player has provided sufficient credit to commence playing. The mechanism 24 may, instead of the coin input chute 24.1 or the bill collector 24.2, or in addition thereto, be a credit 20 card reader (not shown) or any other type of validation device.

Finally, the controller 36 drives a payout mechanism 40 which, for example, may be a coin hopper for feeding coins to the coin tray 30 to make a payout to a player when the player wishes to redeem his or her credit.

Figure 3:
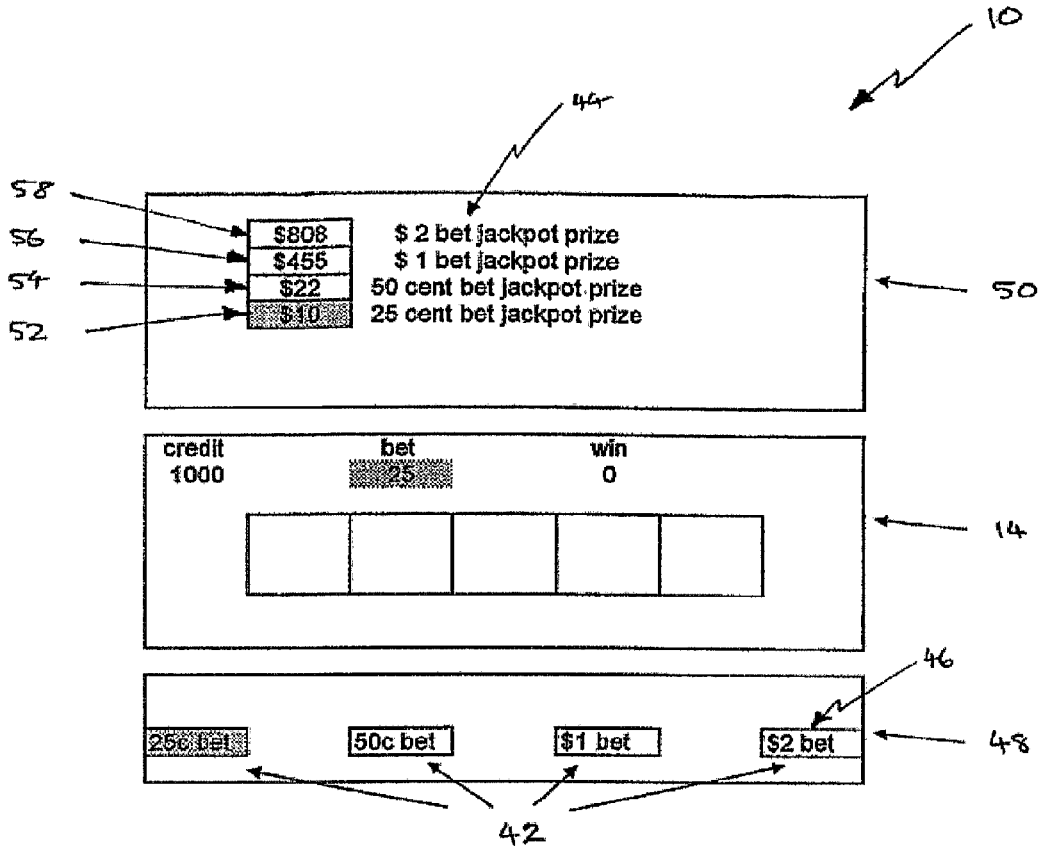
FIG. 3 shows a schematic drawing of a first embodiment of the gaming machine.

Referring now to FIG. 3 of the drawings, a first embodiment of the invention is illustrated. A number of progressive jackpot prizes 44 are associated with the gaming machine 10. Each jackpot prize 44 is associated with a unit bet value 46. In this example, there are four jackpot prizes 44 linked to the gaming machine 10, each jackpot prize 44 being associated with a different unit bet value 46.

The gaming machine 10 allows the player to choose the unit bet value 46 to be wagered. The bank 22 of buttons, of the gaming machine 10, includes a bet selecting arrangement 48. The bet selecting arrangement 48 has a button allocated to each unit bet value 46 that may be wagered by the player. In this example, the bet selecting arrangement 48 has four buttons 42. The gaming machine 10 further includes the secondary display 50 on which the current value of each of the jackpot prizes 44 is displayed. In the illustrative embodiment the secondary display 50 is mounted in the top box 26 of the gaming machine 10. Alternatively the secondary display may form a part of the information or image displayed on the video display unit 14. It will be appreciated that, in addition, the information regarding the values of the jackpot prizes 44 could be displayed on a remote display (not shown).

In use, the player selects the desired unit bet value 46 they wish to wager for the next game play using the bet selection arrangement 42. Having selected the unit bet value 46 the player is eligible to win the jackpot prize 44 associated with their chosen unit bet value 46. In the present example, the unit bet values 46 which the player may choose are twenty-five cents, fifty cents, one dollar, and two dollars. The respective jackpot prizes 44 are, therefore, a twenty-five cents jackpot 52, a fifty cents jackpot 54, a one dollar jackpot 56 and a two dollars jackpot 58.

To illustrate the operation of the game, a situation is taken in which the player has selected the twenty-five cents bet value 46 by operating the button 42. The player is therefore eligible to win the twenty-five cents jackpot 52. In this case, the current value of the twenty-live cents jackpot 52 is ten dollars.

The player then presses a start button, located on the bank 22 of buttons, to initiate a game play. By initiating the game play, a portion of the bet value 46 wagered by the player contributes to the twenty-five cents jackpot 52. If the player had chosen to wager a bet value 46 of fifty cents, the player would contribute to, and be eligible to win, the fifty cents jackpot 54 currently at a value of twenty-two dollars. If the player had chosen to wager a bet value 46 of one dollar, the player would contribute to, and be eligible to win, the one dollar jackpot 56 currently at a value of four hundred and fifty-five dollars. Finally, if the player had chosen to wager a bet value 46 of two dollars, the 30 player would contribute to, and be eligible to win, the two dollars jackpot 58 currently at a value of eight hundred and eight dollars.

Figure 4:
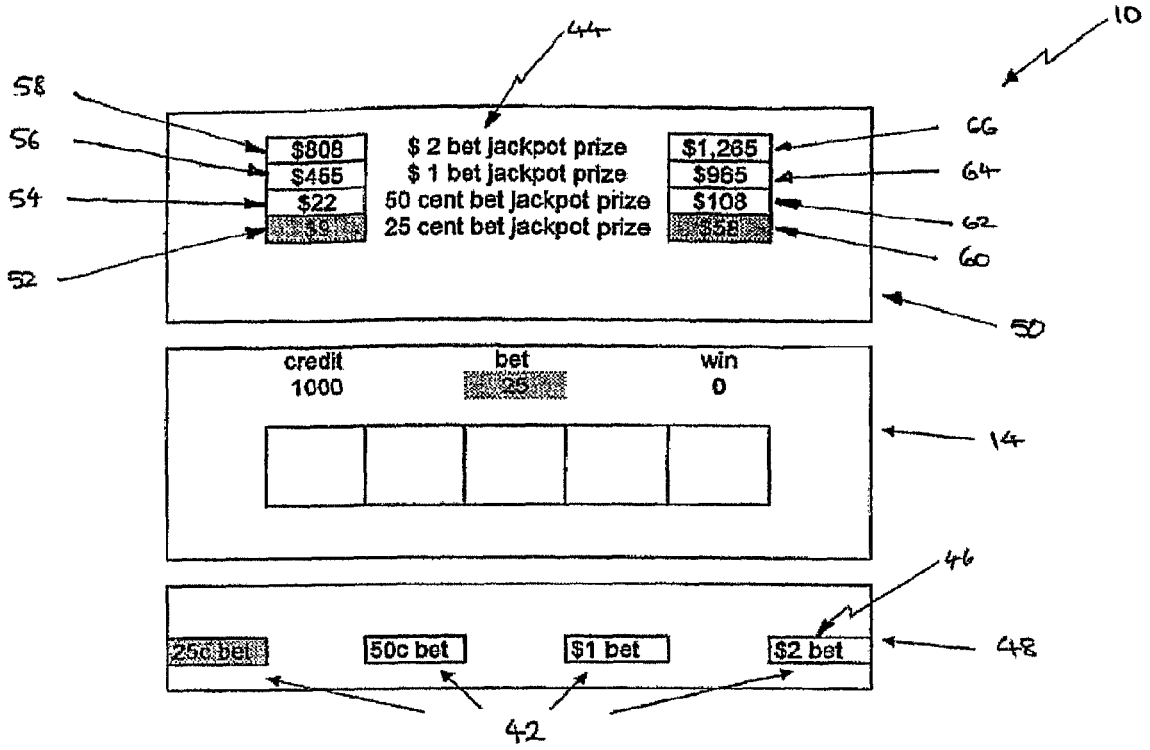
FIG. 4 shows a schematic drawing of a second embodiment of the gaming machine.

Referring now to FIG. 4 of the drawings, a second embodiment of the invention is illustrated.

In this embodiment, for each bet value 46 available to a player, there are two associated jackpot prizes 44. For a player selecting to wagered a bet value 46 of twenty-five cents the player would contribute to, and be eligible to win, both a first twenty-five cents jackpots 52 and a second twenty-five cents jackpot 60. The first twenty-five cents jackpot 52 is currently at a value of nine dollars and the second twenty-five cents jackpot 60 is currently at a value of fifty-eight dollars.

For a player selecting to wager a bet value 46 of fifty cents the player would contribute to, and be eligible to win, both a first fifty cents jackpot 54 and a second fifty cents jackpot 62. The first fifty cents jackpot 54 is currently at a value of twenty-two dollars and the second fifty cents jackpot 62 is currently at a value of one hundred and eight dollars.

For a player selecting to wager a bet value 46 of one dollar the player would contribute to, and be eligible to win, both a first one dollar jackpot 56 and a second one dollar jackpot 64. The first one dollar jackpot 56 is currently at a value of four hundred and fifty-five dollars and the second one dollar jackpot 64 is currently at a value of nine hundred and sixty-five dollars.

For a player selecting to wager a bet value 46 of two dollars the player would contribute to, and be eligible to win, both a first two dollars jackpot 58 and a second two dollars jackpot 66. The first two dollars jackpot 58 is currently at a value of eight hundred and eight dollars and the second two dollars jackpot 66 is currently at a value of one thousand two hundred and sixty-five dollars.

It will be appreciated that, in general, in each case, the player's contribution to the jackpots 44 is divided between the respective jackpots corresponding to the amount wagered by the player. The portion of the wager allocated to the second, larger jackpot is greater than that allocated to the first, smaller jackpot. However, it will also be understood that, in certain circumstances, it may be desirable to increase the smaller jackpot at a greater rate than the larger jackpot. In such a case, a larger portion of the wager may be allocated to the smaller jackpot than the larger jackpot.

From this embodiment, it will also be appreciated that any number of jackpot prizes 44 could be associated with each bet value 46 and that any number of bet values could have one or more dedicated jackpot prizes associated therewith.

Figure 5:
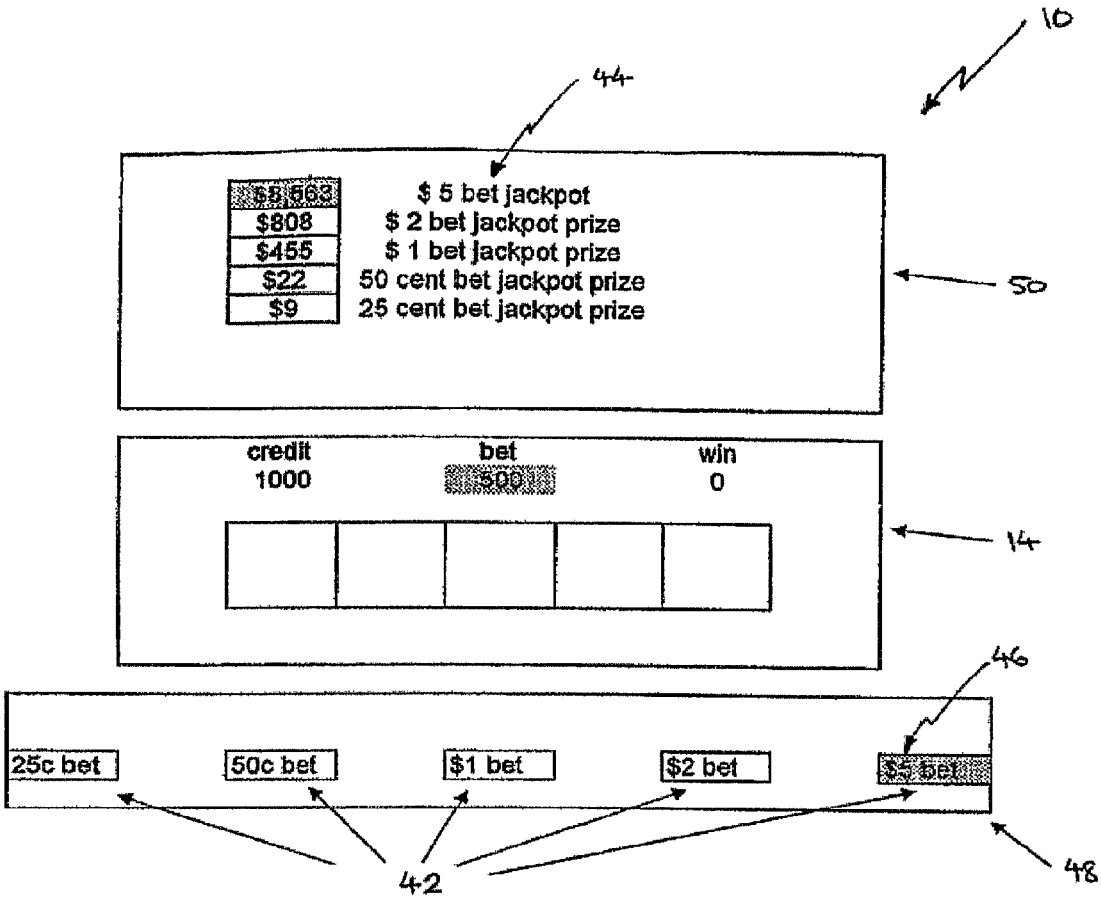
FIG. 5 shows a schematic drawing of a third embodiment of the gaming machine.

Referring now to FIG. 5 of the drawings, a third embodiment of the invention is illustrated.

In this embodiment, the gaming machine 10 has five bet values 46 from which the player may choose. Once again, for each bet value 46 there is an associated jackpot prize 44. Therefore, in this embodiment, there are five jackpot prizes 44. It will be appreciated that a gaming machine 10 in accordance with the present invention could have any number of bet values 46, with each bet value 46 having an associated jackpot prize 44. It is an advantage of an embodiment of the invention that a plurality of gaming machines may be linked to the jackpot prizes. The linked gaming machines may be of the same type or a combination of different types of machines. Thus, embodiments of the present invention may be applied to a group of spinning reel type games, card games or keno games or a combination of these. Also, by providing a jackpot prize associated with the bet value wagered, the applicant believes, the enjoyment and interest of a player will be enhanced. Still further a player can be eligible to win one or more jackpot prizes without necessarily having to place a maximum wager. Thus, players can still benefit from jackpot prizes even if making relatively small wagers.

It will be appreciated by persons skilled in the all that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A gaming system comprising:

a game controller that facilitates a play of a game of chance in which a player is able to place a wager on an outcome of the game of chance in return for the opportunity to win a prize;

a user interface that displays to the player a plurality of different absolute wager amounts and allows the player to select one of the absolute wager amounts to be used for the wager on the outcome of the game of chance; and a jackpot arrangement that maintains at least two separate jackpots for each one of the absolute wager amounts to provide a plurality of jackpots, selects the at least two jackpots based on the one of the absolute wager amounts selected by the player, and increments the at least two jackpots selected by allocating a first portion of the absolute wager amounts selected and wagered by the player to the at least two jackpots selected, while a second portion of the absolute wager amount is allocated to play of the game of chance, wherein said first portion is divided between the at least two jackpots unequally such that the at least two jackpots increase at different rates respectively.

2. The gaming system as claimed in claim 1, wherein the user interface comprises a plurality of buttons each of which represents a different one of the absolute wager amounts.

3. The gaming system as claimed in claim 1, wherein the jackpot arrangement awards to the player one of the jackpots of the at least two jackpots selected based on the one of the absolute wager amounts selected by the player in response to the outcome of the game satisfying a predefined criterion.

4. The gaming system as claimed in claim 1, further comprising:

a gaming machine in which resides the game controller, wherein the gaming machine is configured to receive the wager placed by the player, display the outcome of the game of chance, and award the player a prize in response to the outcome of the game of chance corresponding to a winning event.

5. The gaming system as claimed in claim 1, wherein:

the game controller awards the player a prize in response to the outcome of the game of chance corresponding to a winning event; and the prize awarded by the game controller includes one of the at least two jackpots selected in response to the outcome of the game of chance corresponding to a jackpot winning event.

6. The gaming system of claim 1, wherein the user interface is further configured to display current values for each of the at least two jackpots associated with each of the absolute wager amounts.

7. A method for use with a gaming system comprising a gaming machine, the method comprising:

facilitating a play of a game of chance on the gaming machine in which a player is able to place a wager on an outcome of the game of chance;

displaying to the player, via the gaming machine, a plurality of different absolute wager amounts;

allowing the player to select one of the absolute wager amounts to be used for the wager on the outcome of the game of chance;

maintaining at least two separate jackpots for each one of the absolute wager amounts to provide a plurality of jackpots;

selecting the at least two jackpots based on the one of the absolute wager amounts selected by the player; and incrementing the at least two jackpots selected by allocating a first portion of the absolute wager amounts selected and wagered by the player to the at least two jackpots selected, while a second portion of the absolute wager amount is allocated to play of the game of change, wherein said first portion is divided between the at least two jackpots unequally such that the at least two jackpots increase at different rates respectively.

8. The method as claimed in claim 7, further comprising awarding to the player one of the jackpots of the at least two jackpots selected based on the one of the absolute wager amounts selected by the player in response to the outcome of the game satisfying a predefined criterion.

9. The method as claimed in claim 7, further comprising:

receiving, with the gaming machine, the wager placed by the player;

display, with the gaming machine, the outcome of the game of chance; and awarding the player a prize, with the gaming machine, in response to the outcome of the game of chance corresponding to a winning event.

10. The method as claimed in claim 7, further comprising:

awarding the player a prize, with the gaming machine, in response to the outcome of the game of chance corresponding to a winning event;

wherein said awarding comprises including one of the at least two jackpots selected in response to the winning event corresponding to a jackpot winning event.

11. The method of claim 7, further comprising displaying to the player, via the gaming machine, current values for each of the at least two jackpots associated with each of the absolute wager amounts.

* * * * *

UNITED STATES PATENT AND TRADEMARK OFFICE

CERTIFICATE OF CORRECTION

PATENT NO. : 8,585,491 B2
APPLICATION NO. : 12/690668
DATED : November 19, 2013
INVENTOR(S) : Chi We Chem et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 255 days.

Signed and Sealed this
Twenty-first Day of April, 2015

Michelle K. Lee

Michelle K. Lee
*Director of the United States Patent and Trademark Office*